US006889748B2

(12) United States Patent
Fischer et al.

(10) Patent No.: US 6,889,748 B2
(45) Date of Patent: May 10, 2005

(54) DEVICE FOR THE CONTINUOUS CASTING OF METALS, ESPECIALLY STEEL

(75) Inventors: Lothar Fischer, Kaarst (DE); Adolf Zajber, Langenfeld (DE); Thomas Fest, Moers (DE); Siegbert Schwenecke, Sonsbeck-Hamb (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/204,818

(22) PCT Filed: May 5, 2001

(86) PCT No.: PCT/EP01/05117

§ 371 (c)(1),
(2), (4) Date: Aug. 23, 2002

(87) PCT Pub. No.: WO01/85370

PCT Pub. Date: Nov. 15, 2001

(65) Prior Publication Data

US 2003/0010470 A1 Jan. 16, 2003

(30) Foreign Application Priority Data

May 10, 2000 (DE) ..... 10022598.5

(51) Int. Cl.[7] ..... B22D 11/053; B22D 11/04
(52) U.S. Cl. ..... 164/416; 164/478
(58) Field of Search ..... 164/478, 416

(56) References Cited

U.S. PATENT DOCUMENTS 5,201,909 A * 4/1993 Von Wyl et al. ..... 164/418
5,771,957 A 6/1998 Von Wyl et al.
6,443,218 B1 * 9/2002 Hornschemeyer ..... 164/418

FOREIGN PATENT DOCUMENTS

| | | |
|---|---|---|
| EP | 0468607 | 1/1992 |
| EP | 0953391 | 11/1999 |
| WO | 9726098 | 7/1997 |

OTHER PUBLICATIONS

Nadif M et al: Cahiers D'Informations Techniques de la Revue de Metallurgie BD. 91, No. 7/08, Jul. 1, 1994 pp. 1071–1079.

Patent Abstracts of Japan, vol. 015, No. 325 (M–1148), Aug. 19, 1991 & JP 03 124353 A (Sumitomo Metal Ind Ltd), May 27, 1991.

* cited by examiner

*Primary Examiner*—Kuang Y. Lin
(74) *Attorney, Agent, or Firm*—Friedrich Kueffner

(57) ABSTRACT

The invention relates to a device for the continuous casting of metals, especially steel, by means of a continuous casting mold (1) which is mounted in an oscillating frame (3). Said oscillating frame can be driven so that it oscillates in the direction of casting (2), the course of the oscillation movement and/or the frequency being adjustable. The oscillating frame (3) is mounted with spring assemblies (4*a*, 4*b*; 5*a*, 5*b*) arranged symmetrically on both sides of the strand, for guiding and weight compensation. The device is used on a continuous casting mold (1) with a shaped casting cross-section (1*a*), which is mounted in the oscillating frame (3). The leaf-spring-mounted oscillating frame (3) can be operated with the continuous casting mold (1) in a resonance oscillation method in order to give the preliminary section a better surface.

5 Claims, 2 Drawing Sheets

DEVICE FOR THE CONTINUOUS CASTING OF METALS, ESPECIALLY STEEL

The invention concerns machinery for the continuous casting of metals, especially steel, by means of a continuous casting mold, which is mounted in an oscillating frame that can be reciprocated in the direction of casting. The amplitude and/or the frequency of the oscillation can be adjusted. The oscillating frame is mounted with spring assemblies, which are symmetrically arranged on both sides of the strand, for guidance and weight compensation.

The continuous casting of slabs, e.g., with a casting cross section of 210/250×1,000–2,050 mm, on a so-called resonance mold is well known (EP 0,468,607 B1). The advantages of this type of resonance mold are basically a reduction in weight of the oscillating components and improvement of the dynamics, so that the features of a servohydraulic drive can be utilized. The liquid-cooled continuous casting mold used for this purpose in an oscillation arrangement has spring elements, which have significantly lower stiffness in the casting direction than the transverse directions, are uniformly distributed, are mounted on one side, and extend transversely to the direction of casting. The opposite ends of the spring elements are mounted on a base plate, and the base plate is fastened to a stationary base frame. The reciprocating drive acts on the supporting plate. Leaf springs of this design are also known, such that the nonrigid leaf springs are mounted in parallel position both with respect to one another and with respect to the leaf springs located on the opposite narrow side of the mold (EP 0,953,391 A1).

The casting of shaped strands (except for simple polygonal shapes) is technologically demanding, because the frictional force and the casting flux criteria for individual varieties of steel are largely undetermined. Therefore, poor strand surfaces are repeatedly obtained due to high frictional forces. In the extreme case, sticking-type breakouts destroy the result of the entire operation and cause severe economic loss. Casting cross sections where the longitudinal and narrow sides of the mold are nonuniform are affected to an even greater extent.

The goal of the invention is to improve the casting of cross sections that are complicated compared to simple rectangular slab cross sections.

In accordance with the invention, this goal is achieved with machinery, of the type described at the beginning, for the continuous casting of metals, especially steel, by the use of a continuous casting mold with a shaped cross section, which is mounted in the oscillating frame, such that the oscillating frame, which is mounted on leaf springs, and the continuous casting mold can be operated by the resonance oscillation method. The use of leaf springs ensures deflection that is free of backlash and wear with guiding precision that is many times better than that of previous oscillation equipment and thus significantly reduced strand friction. A sinusoidal oscillation or a nonsinusoidal oscillation with high frequencies and small amplitudes contributes to this. Moreover, this so-called resonance oscillation is promoted by a reduction in weight of the oscillating frame components. It is now possible to produce high surface quality even on shaped casting strands, which is associated with improvement of the cast structure near the edges. In addition, the crack sensitivity can also be reduced.

The advantages of the invention can be illustrated by a selected design example in which the continuous casting mold produces a casting cross section that is shaped like a dog bone.

Due to the characteristics of the so-called resonance mold that have been described, the strand surface can be improved basically by variation of the oscillatory motion by the drive with respect to the oscillation amplitude and/or the oscillation frequency and/or the oscillation curve. The reduction of friction can be computed with computer models, and the values obtained in this way can be input to control the particular drive.

One design provides for influencing the frictional force by the amplitude of the oscillatory motion of the oscillating frame. The continuous casting mold operated by the resonance method can be given a low friction value by adjusting the amplitude of the oscillatory motion of the oscillating frame to about 0.3–6 mm.

In accordance with one improvement, the continuous casting mold for the resonance oscillation method is mounted in such a way that leaf spring assemblies that run in pairs on both sides at an acute angle to each other are flexibly mounted at both ends, and that the oscillating frame that supports the continuous casting mold is mounted by means of supporting brackets, which are secured at the midpoint of the leaf spring assemblies and which join the leaf spring assemblies and the oscillating frame. This mounting produces the desired precise guidance using structural members of the lowest possible weight.

In general, the invention provides that the upper pair of leaf spring assemblies is horizontally mounted in the base frame, which itself is horizontal or inclined.

In accordance with additional features of the invention, the surface of the solidifying strand being cast can be monitored by providing the oscillating frame with a hydraulic drive to which a measuring device is connected for determining the pressures in the working cylinder, which can then be used to compute the frictional force between the strand being cast and the continuous casting mold.

Finally, another measure for homogeneous surface forming consists in the use of an automatic casting flux feeder. This assures more uniform distribution of the casting flux and further reduction of friction. The invention will now be explained in greater detail with reference to the embodiment shown in the drawings.

Figure 1:
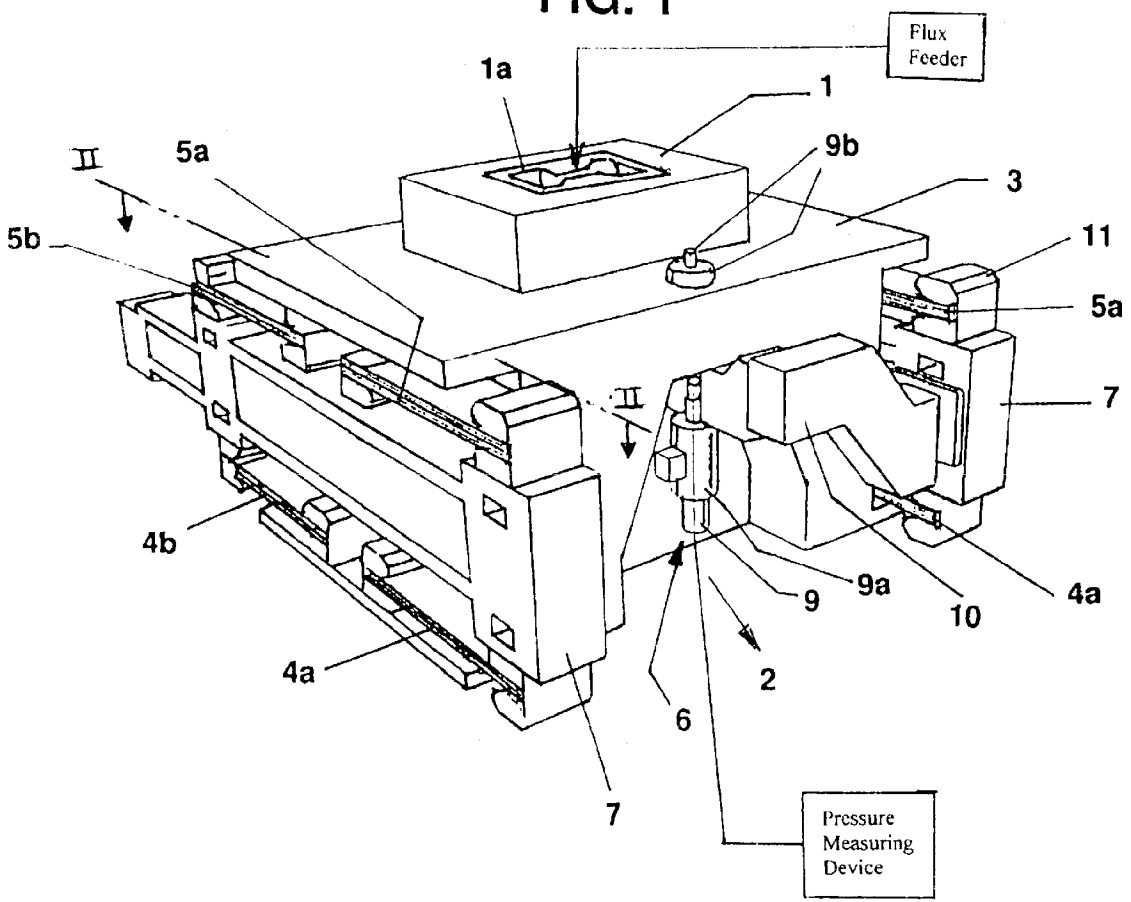
FIG. 1 shows a perspective view of a resonance continuous casting mold.

FIG. 1 shows machinery for the continuous casting of metals, especially steel, by means of a continuous casting mold 1, which is mounted in an oscillating frame 3 that can be reciprocated in the direction of casting 2. The amplitude and/or the frequency of the oscillation can be adjusted. The oscillating frame 3 is mounted with spring assemblies 4*a*, 4*b*; 5*a*, 5*b*, which are symmetrically arranged on both sides of the strand, for guidance and weight compensation. The continuous casting mold 1 has a shaped casting cross section 1*a*, and the oscillating frame 3, which is mounted on the leaf springs, and the continuous casting mold 1 can be operated by the resonance oscillation method. A dog-bone mold is shown as a good example of a shaped casting cross section 1*a*, with which the starting material for I-beam sections is cast. A homogeneous surface without serious defects is produced by varying the oscillatory motion by means of the drive 6 with respect to the oscillation amplitude and/or the oscillation frequency and/or the oscillation curve. This oscillatory motion can be transmitted to the oscillating frame 3 by a hydraulic, electric, or electromechanical drive 6. In this regard, the friction is to be influenced by means of the amplitude of the oscillatory motion of the oscillating frame, i.e., it is to be kept as small as possible. The frictional force and the surface quality can be influenced especially by relatively low amplitudes of the oscillatory motions, e.g., by adjusting the amplitude of the oscillatory motion of the oscillating frame to about 0.3–6 mm. The drive 6 acts on the oscillating frame at the point of application 6*a* indicated on the left side of FIG. 2.

Figure 2:
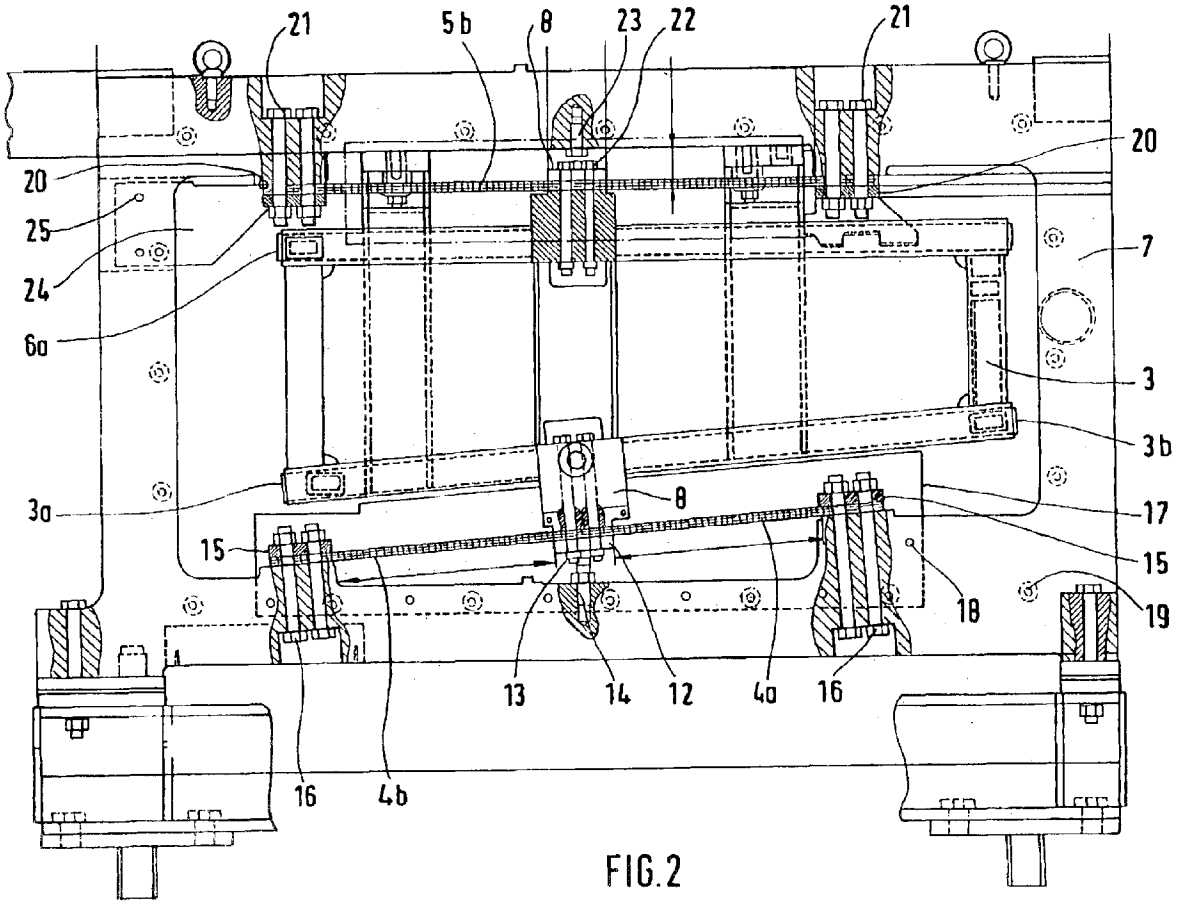
FIG. 2 shows a section through a resonance continuous casting mold.

The design of the mold oscillation equipment is shown in greater detail in FIG. 2. In a base frame 7, leaf spring assemblies run in pairs on both sides at an acute angle to each other (assemblies 4*a* and 4*b* below and 5*a* and 5*b* above).

The drive 6 for the oscillatory motions may consist, as shown in FIG. 1, of a hydraulic drive 9 with a working cylinder 9*a*, whose driving rod 9*b* passes through the oscillating frame and is bolted into it. The oscillating frame 3 is supported on a crossrail 10 for the drive 6. Each of the leaf spring assemblies 4*a*, 4*b* and 5*a*, 5*b* is clamped at its end by means of a spring clamp 11, as is clearly shown in FIG. 2.

As FIG. 2 shows, a base frame 7 supports the oscillating frame 3, which has a lower standard that supports a supporting bracket 8. The oscillating frame 3 is joined to the base frame 7 by means of a fastening plate 12 and supporting bracket bolted joints 13 (each consisting of a bolt, a nut and a washer), which also clamp the leaf spring assemblies 4*a*, 4*b* (5*a*, 5*b*). The movement of the oscillating frame 3 is limited below by a safety stop 14.

Each of the leaf spring assemblies 4*a*, 4*b* (5*a*, 5*b* on the other side) is mounted on the base frame 7 in the same way by a lower fastening plate 15 and bolted joints 16. The placement of each of the leaf spring assemblies 4*a*, 4*b* is spatially terminated by a guard plate 17. A centering rod 18 and lateral connecting bolts 19 are also present.

In the upper part of the base frame 7, the leaf spring assemblies 5*a*, 5*b* are mounted by upper fastening plates 20 and upper bolted joints 21. In an analogous design, the upper supporting bracket 8 is provided with upper supporting bracket bolted joints 22 and an upper stop 23. For the upper leaf spring assemblies 5*a* and 5*b*, a base frame part 24 is likewise provided for bounding the leaf spring assembly 5*b*. Joining elements 25 are also shown.

| List of Reference Numbers | |
|---|---|
| 1 | continuous casting mold |
| 1a | shaped casting cross section |
| 2 | casting direction |
| 3 | oscillating frame |
| 3a | end |
| 3b | end |
| 4a | leaf spring assembly |
| 4b | leaf spring assembly |
| 5a | leaf spring assembly |
| 5b | leaf spring assembly |
| 6 | drive |
| 6a | point of application for the drive |
| 7 | base frame |
| 8 | supporting bracket |
| 9 | hydraulic drive |
| 9a | working cylinder |
| 9b | driving rod with bolted joint |
| 10 | crossrail for the drive |
| 11 | spring clamp |
| 12 | lower fastening plate |
| 13 | lower supporting bracket bolted joint |
| 14 | safety stop |
| 15 | lower fastening plate |
| 16 | bolted joint |

-continued

| List of Reference Numbers | |
|---|---|
| 17 | guard plate |
| 18 | centering rod |
| 19 | lateral connecting bolt |
| 20 | upper fastening plate |
| 21 | upper bolted joints |
| 22 | upper supporting bracket bolted joint |
| 23 | upper stop |
| 24 | base frame part |
| 25 | joining elements |

What is claimed is:

1. Machinery for continuously casting metals, comprising: an oscillating frame that is reciprocable in a casting direction so that at least one of amplitude and frequency of the oscillation are adjustable; a continuous casting mold mounted in the oscillating frame; leaf spring assemblies having leaf springs, the oscillating frame being mounted on the leaf spring assemblies, the leaf springs being symmetrically arranged on both sides of a cast strand, for guidance and weight compensation, the continuous casting mold having a shaped casting cross section with a dog-bone shape mounted in the oscillating frame so that the oscillating frame, which is mounted on the leaf springs, and the continuous casting mold are operable by a resonance oscillation method; a drive operative to vary the oscillatory motion with respect to at least one of oscillation amplitude, oscillation frequency and oscillation curve, the oscillating frame being configured so that the frictional force between the strand and the mold can be influenced by the amplitude of the oscillation or by the type of oscillatory motion of the oscillating frame; a pressure measuring device connected to said drive for measuring pressures in said drive; computing means for computing friction force from the measured pressures; means for adjusting amplitude of the oscillatory motion of the oscillating frame to about 0.3–6 mm based on the measured friction force; and a base frame, the leaf spring assemblies being arranged to run in pairs on both sides at an acute angle to each other, and flexibly mounted at both ends, the oscillating frame that supports the continuous casting mold is mounted by supporting brackets, which are secured to the leaf spring assemblies between the ends and which join the leaf spring assemblies and the oscillating frame.

2. Machinery in accordance with claim 1, wherein the drive is one of hydraulic, electric and electromechanical.

3. Machinery in accordance with claim 1, wherein the upper pair of leaf spring assemblies is horizontally mounted in the base frame, which itself is horizontal or inclined.

4. Machinery in accordance with claim 1, and further comprising a hydraulic drive operatively arranged to oscillate the oscillating frame, a measuring device being connected to the hydraulic drive for determining pressures in a working cylinder of the hydraulic drive, the pressures being useable to compute frictional force between the casting strand and the continuous casting mold.

5. Machinery in accordance with claim 1, and further comprising an automatic casting flux feeder.

* * * * *